US008035466B2

(12) United States Patent
Payne

(10) Patent No.: US 8,035,466 B2
(45) Date of Patent: Oct. 11, 2011

(54) HIGH FREQUENCY ELECTRICAL CONNECTOR

(76) Inventor: Kenneth Ray Payne, Boynton Beach, FL (US)

( * ) Notice: Subject to any disclaimer, the term of this patent is extended or adjusted under 35 U.S.C. 154(b) by 145 days.

(21) Appl. No.: 12/319,736

(22) Filed: Jan. 12, 2009

(65) Prior Publication Data

US 2010/0176896 A1 Jul. 15, 2010

(51) Int. Cl.
*H01P 5/08* (2006.01)

(52) U.S. Cl. ..... 333/260; 333/33; 439/581; 439/63

(58) Field of Classification Search ..... 333/260, 333/33; 439/581, 63, 74, 79
See application file for complete search history.

(56) References Cited

U.S. PATENT DOCUMENTS 5,897,384 A * 4/1999 Hosler, Sr. ..... 439/63
6,254,399 B1 * 7/2001 Huang ..... 439/63
6,811,405 B1 * 11/2004 Huang ..... 439/63
7,042,318 B2 * 5/2006 Barnes et al. ..... 333/260
7,344,381 B2 * 3/2008 Kerekes ..... 439/63
7,713,067 B1 * 5/2010 Behrent ..... 439/63

* cited by examiner

*Primary Examiner* — Stephen Jones
(74) *Attorney, Agent, or Firm* — Gregg Rasor

(57) ABSTRACT

A coaxial to transmission line connector has a connector and an attachment area with a windowed electrical attachment point that when soldered in place on a ground reference of an electrical device, creates an electrical and mechanical connection between an outer conductor of the coaxial to transmission line connector. The attachment area has at least one mechanical alignment point and a corresponding reference pivot point located substantially co-planar at the termination of the coaxial dielectric region at an edge of a PCB and a port of the coaxial to transmission line connector. The at least one mechanical alignment point and the corresponding reference pivot plane serve to automatically align the coaxial to transmission line connector to the electrical device. Opposite the attachment area is a dielectric area following termination of the outer conductor in the transition area of the microstrip transmission line.

15 Claims, 6 Drawing Sheets

PRIOR ART Figure 5

HIGH FREQUENCY ELECTRICAL CONNECTOR

FIELD OF THE INVENTION

This invention relates to extending the upper frequency range of end-launch PCB (printed circuit board) RF (radio frequency) and microwave connectors while allowing an easy method of attaching the connector to a PCB.

BACKGROUND OF THE INVENTION

Many RF circuit boards need one or more RF connectors that allow incoming or outgoing RF signals connected to other circuit boards or connection into RF systems, which contain cables and other RF devices. A method of attaching the RF connector onto a PCB for easy assembly is needed to keep manufacturing costs low since many satellite and cable TV devices require many RF connectors. Satellite and cable TV devices such as amplifiers and splitters are typically interconnected into systems, which utilize interconnecting cables to connect to other components that distribute satellite or cable TV signals to television viewers. The standard satellite and cable TV coaxial cable characteristic impedance is 75 ohm. Currently, RF test equipment that has a reference impedance of 75 ohm will only test components and cables at frequencies up to 3 GHz. Thus, all 75 ohm RF connectors are tested to only 3 GHz. Due to these limitations, 75 ohm connectors, such as the f-connector, will only work with frequencies somewhere below 3 GHz.

Thus, what is needed is an RF connector that is easily aligned, attached, and held in place while soldering that has good RF electrical characteristics at much higher frequencies.

BRIEF DESCRIPTION OF THE DRAWINGS

A more complete understanding of the method and apparatus of the present invention may be had by reference to the following detailed description when taken in conjunction with the accompanying drawings wherein.

DESCRIPTION OF A PREFERRED EMBODIMENT

Figure 1:
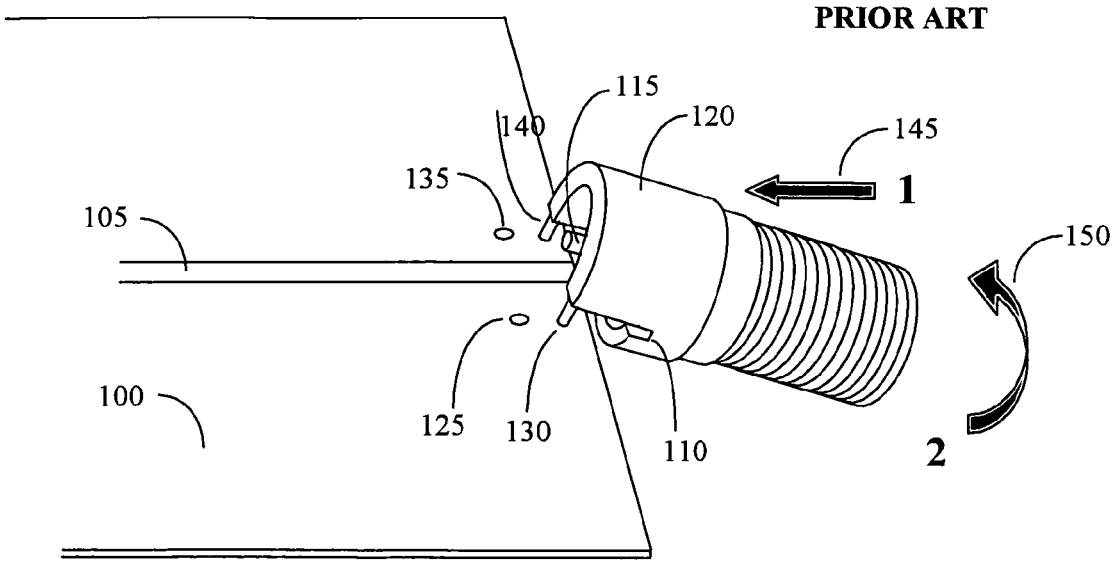
FIG. 1 is a diagram detailing the assembly procedure of attaching a RF connector onto a PCB.

Generally, individual PCB RF circuits are connected to an RF connector by use of a microstrip transmission line 105 as shown in FIG. 1. Attaching an RF connector to a PCB can be difficult and time consuming. The connector center conductor 115 must be soldered to microstrip transmission line 105. The connector outer conductor or shield must be soldered to the PCB 100 ground plane. Best performance is achieved if the connector outer conductor is well connected to the bottom PCB 100 ground plane. The connector becomes extremely hot when it is heated for soldering, thus it can be difficult to hold in place during the soldering process. A connector is shown that allows an easy solder assembly. This connector is mechanically held in place by slots 110, pegs 130 and 140, and PCB holes 125 and 135. Shroud 120 is part of the outer conductor or shield and holds pegs 130 and 140 in place on the connector. Since the connector is mechanically held in place by PCB 100, it is much easier to solder the connector onto the board. Further, this approach allows a solder paste screen print then solder re-flow assembly process. Thus, the connector can be soldered onto the board along with surface mount electronic components that comprise a circuit on PCB 100. Mechanical assembly is straightforward. Referring to FIG. 1, the connector is aligned with the edge of PCB 100. Step 1 is shown by arrow 145 and indicates the assembly motion that pushes the connector onto the edge of PCB 100. Slots 110 go over the edge of PCB 100, until the PCB 100 hits the back of slots 110. Pegs 130 and 140 are then aligned with holes 125 and 135 in PCB 100. The step 2 assembly motion is shown by arrow 150, where a pivoting motion snaps pegs 130 and 140 into PCB holes 125 and 135. The connector is now mechanically aligned and held in place for the soldering process.

Figure 2:
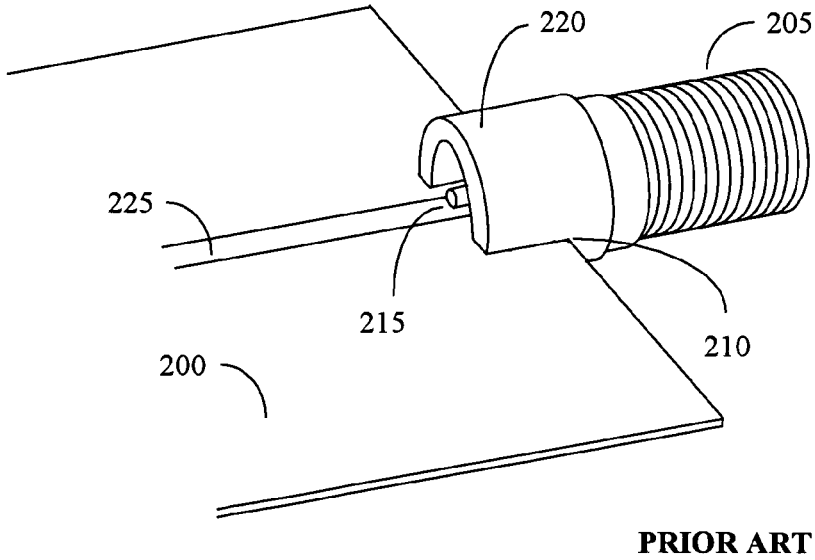
FIG. 2 is an isometric view of a PCB top with the RF connector attached.
Figure 3:
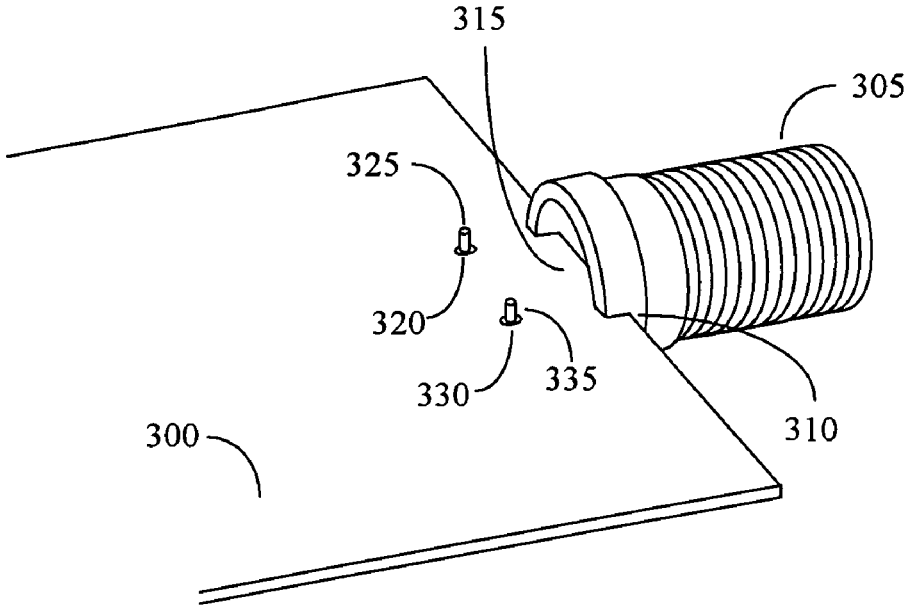
PRIOR ART Figure 3
FIG. 3 is an isometric view of a PCB bottom with the RF connector attached.

FIGS. 2 and 3 show the RF connector attached to a PCB 200 (300) that has solid copper covering the entire bottom side. This copper is used as the reference ground plane. The microstrip transmission line 225 in FIG. 2 is known as a distributed circuit. In other words, it is spread out over a given area in order to obtain certain electrical characteristics. A transmission line has a certain amount of inductance per unit length as well as a certain amount of capacitance per unit length in order to achieve a particular characteristic impedance. If the inductance per unit length and capacitance per unit length is carefully maintained along the transmission line length, the transmission line characteristic impedance is purely real over a very broad range of RF and microwave frequencies and ideally has no reactance. Both inductance per unit length and capacitance per unit length must be maintained simultaneously along the transmission line length in order to maintain the real impedance. The microstrip copper trace 225 has capacitance with respect to the ground plane on the bottom side of PCB 200 (300). The amount of distributed capacitance is set by the trace 225 width, the thickness of PCB 200 (300), and the dielectric constant of PCB 200 (300). Thus, when an RF signal flows down trace 225, a time-varying electric field is present between trace 225 and the copper ground plane on the bottom of PCB 200 and gives rise to the distributed capacitance. Similarly, when an RF signal flows down trace 225, a time-varying magnetic field is present around trace 225 and gives rise to the distributed inductance. If there is an interruption along the length of the transmission line structure in either the physical inductance or physical capacitance, the characteristic impedance is no longer purely real, but will also have reactive impedance in addition to the real part impedance. In other words, in the area where the physical inductance or physical capacitance is interrupted, the impedance becomes reactive. For example, if some of the ground plane is removed from an area underneath the microstrip transmission line 225, that area no longer has a broadband real impedance, but instead, has an inductive reactive impedance since the capacitance per unit length has been removed, but the inductance per unit length has been maintained. If the inductance (capacitance) per unit length of the microstrip changes value in a given area for some reason, but the capacitance (inductance) per unit length remains unchanged in that area, the characteristic impedance in that area will still remain real, but will deviate from the desired value. This is also known as an impedance discontinuity. If distributed inductance in the discontinuity area increases, the characteristic impedance will increase in that area. If distributed inductance in the discontinuity area decreases, the characteristic impedance in that area will decrease. Inversely, if the distributed capacitance in the discontinuity area increases, the characteristic impedance in that area will decrease. If the distributed capacitance in the discontinuity area decreases, the characteristic impedance in that area will increase.

The microstrip is an unbalanced transmission line in that it requires a ground plane underneath it in order to obtain a desired characteristic impedance. PCB 200 must have a large area of copper underneath microstrip line 225 that is dedicated to providing that ground reference. If the ground reference copper has holes or open areas contained within it, an impedance discontinuity can be introduced on the microstrip transmission line as discussed earlier.

FIG. 3 shows the PCB bottom side with the connector attached. Note that pegs 325 and 335 are shown protruding through PCB holes 320 and 330. The back of slot 310 is up against the edge of PCB 300. This ensures that pegs 325 and 335 are aligned with holes 320 and 330 right before the connector is pivoted and snapped into place. Since PCB 300 (200) has a large area of copper on it's bottom side, the connector should have a fillet of solder in area 315 that joins the connector to the bottom side copper ground plane. Threads 205 (305) are shown as the method to attach an RF cable or RF adapter to the connector, but a BNC or push-on connection such as an SMB type are also possible.

Figure 4:
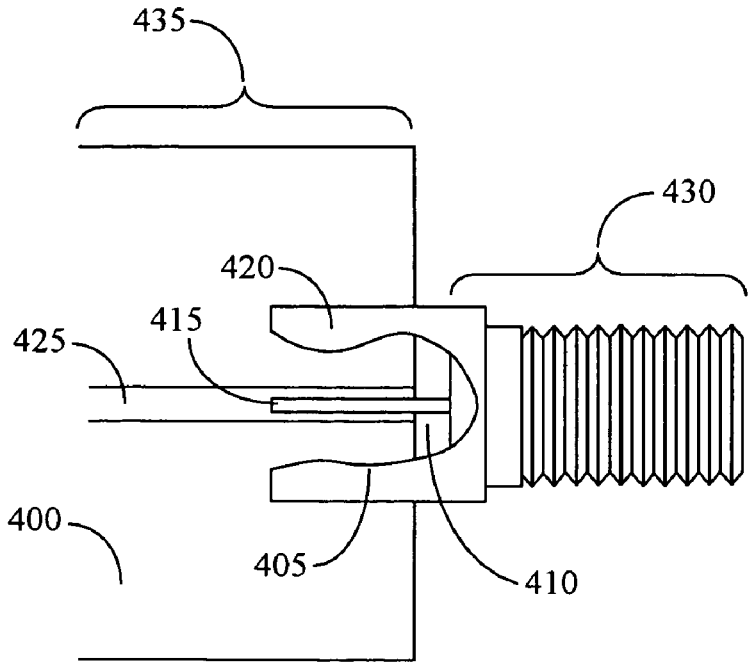
Figure 4 PRIOR ART
FIG. 4 is a top view of the RF connector attached to the PCB with a cutaway view showing a gap between the PCB and connector coaxial section.

FIG. 4 shows a top view of the connector mounted on a PCB 400 with a cutaway 405 in the connector shroud 420. Microstrip transmission line 425 is shown along the PCB length indicated by dimension 435. This is the microstrip transmission line region. The connector itself is a coaxial type transmission line in the region indicated by the 430 dimension. A coaxial type transmission line is similar to a microstrip transmission line with respect to distributed inductance and distributed capacitance. The characteristic impedance of a coaxial transmission line is determined by the outer dimension of the center conductor, the inner dimension of the outer conductor, and the dielectric constant of the insulator separating the inner conductor from the outer conductor. FIG. 4 shows a cutaway 405 in the connector shroud 420 so that the interface between the connector and the PCB 400 are easily observed. The center conductor pin 415 is soldered to the microstrip transmission line 425. The area shown by 410 is a transition region that is not microstrip and is not the same impedance as the coaxial region 430. This region introduces a discontinuity between the coaxial transmission line and the microstrip transmission line since the distributed capacitance changes abruptly from the coaxial region 430.

Figure 5:
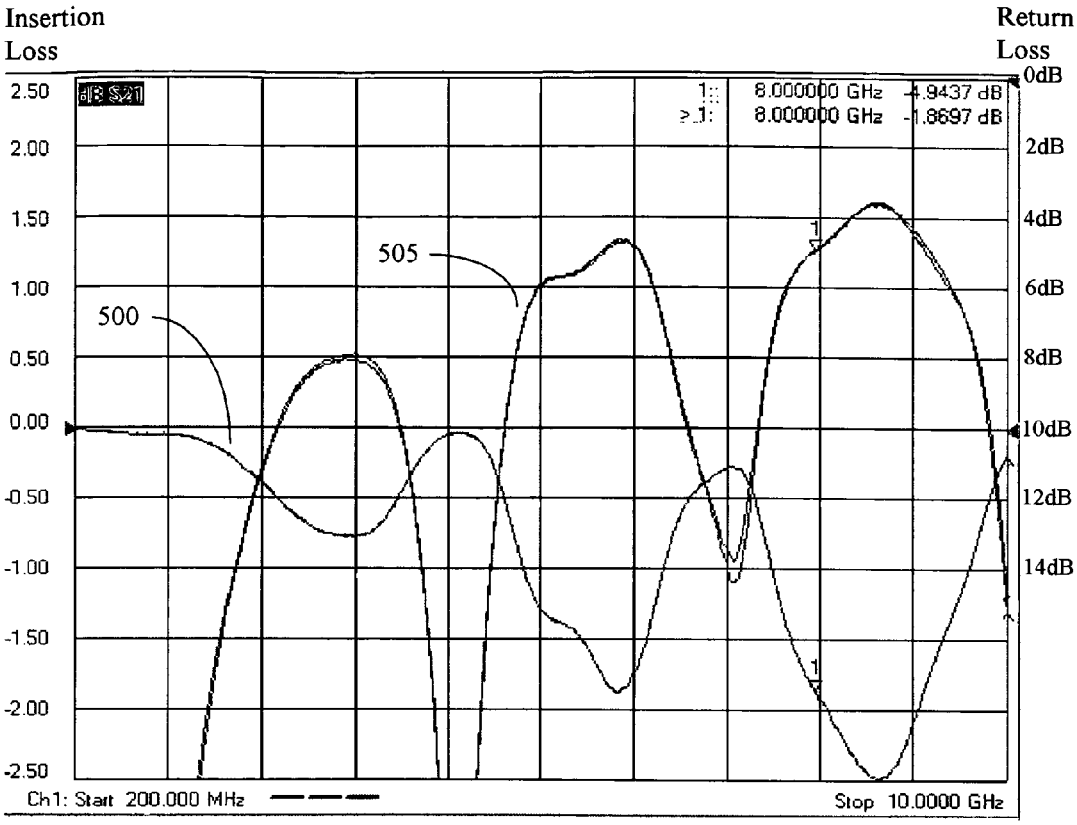
FIG. 5 is an insertion loss and input and output return loss versus frequency plot of the RF connector.

FIG. 5 plots insertion loss 500 and input and output return loss 505 versus frequency for the RF connector. Ideally, insertion loss should be 0 dB and return loss should be ∞dB at all frequencies. The connector works up to only 2 GHz as shown in the plot since it has less than 0.5 dB insertion loss and better than 12 dB return loss up to 2 GHz. At frequencies above 2 GHz the connector exhibits very poor performance. Realistically, if the connector has around 0.5 dB of insertion loss and greater than 10 dB return loss, it could be used in many applications. The connector has an insertion loss as high as 2.5 dB and an input and output return loss as low as 3.5 dB above 2 GHz. Both insertion loss and return loss plots vary up and down versus frequency dramatically. Thus, the connector is unusable at frequencies above 2 GHz.

Inspection of FIGS. 2 and 4 give insight into physical properties that can lead to impedance discontinuities, which in turn, give poor insertion loss and return loss for the RF connector. Shroud 220 is at ground reference with respect to microstrip line 225 and therefore increases the amount of distributed capacitance on the end of the microstrip transmission line. The microstrip transmission line 225 in combination with the connector outer shroud 220 would form a pseudo-coax-microstrip transmission line in the area where the shroud 220 is over the microstrip. The microstrip 225 area covered by connector shroud 220 would have a higher distributed capacitance than what is needed to obtain the desired characteristic impedance on the end of the microstrip line and would therefore cause a decrease in the impedance of the microstrip line in that area. This introduces an impedance discontinuity and is part of the reason the plots of FIG. 5 are so poor. FIG. 4 shows an additional impedance physical discontinuity in region 410. Region 430 can have the desired uniform characteristic impedance without discontinuity since it is a coaxial transmission line structure and region 435 can have the desired uniform characteristic impedance (if it weren't for shroud 420) without discontinuity since it is a microstrip transmission line structure. Region 410 is a transition point between the coaxial transmission line region 430 and the microstrip transmission line region 435. The distance from the inner conductor pin 415 to the outer ground shield or shroud 420 is too large to provide the correct distributed capacitance that maintains the correct coaxial transmission line impedance in area 410. This introduces an additional impedance discontinuity and is part of the reason the plots of FIG. 5 are so poor.

All RF connectors are in some way limited in their frequency range of use based on their associated physical structure. Undesired parasitic inductance and parasitic capacitance exists due to the physical structure in the area where the RF connector attaches to the PCB. The present invention significantly reduces impedance discontinuities where the RF connector attaches to the PCB, yet it is still easily aligned onto a PCB, snapped onto the PCB, and held in place by the PCB during the soldering process. Since the present invention significantly reduces the impedance discontinuities, the operating frequency range is significantly increased from 2 GHz to 10 GHz or more.

Figure 6:
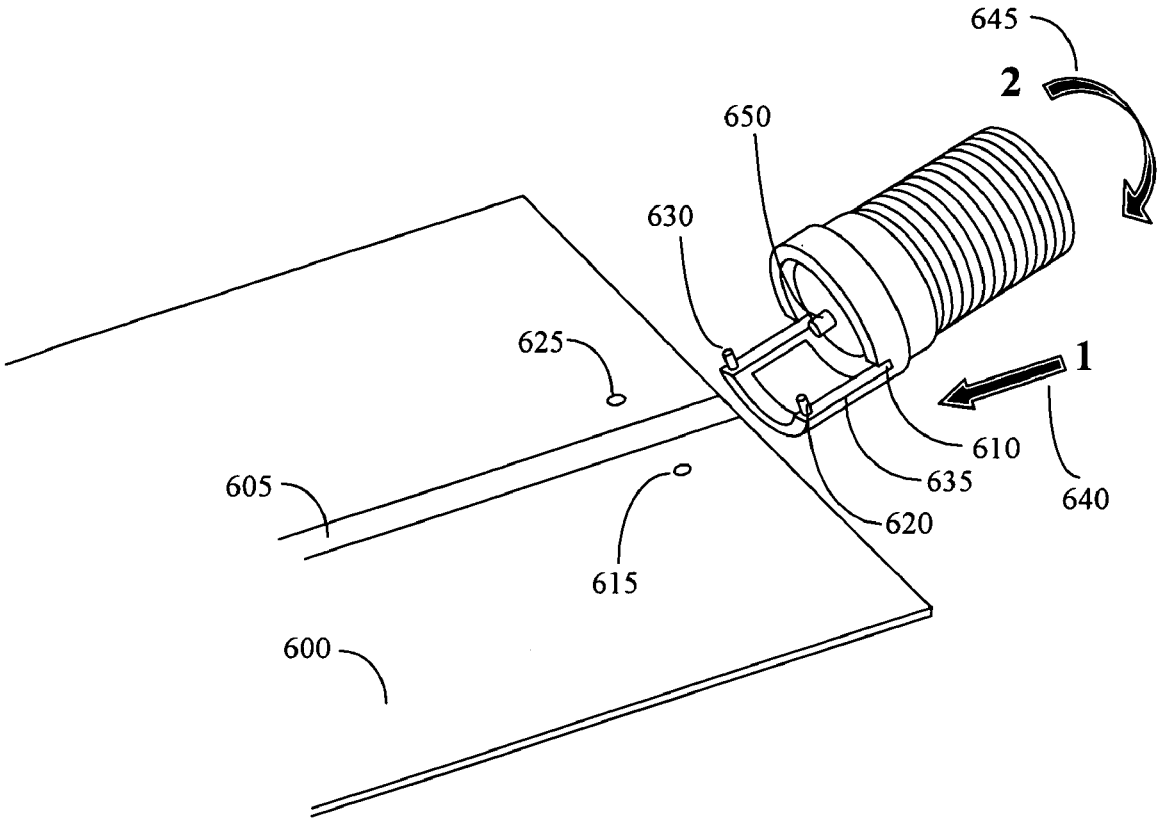
FIG. 6 is a diagram detailing the assembly procedure of attaching a new RF connector onto a PCB.

FIG. 6 shows the assembly procedure of the new RF connector attachment onto the PCB. The new RF connector is mechanically held in place by slots 610, pegs 620 and 630, and PCB holes 615 and 625. Shroud 635 is part of the outer conductor or shield and holds pegs 620 and 630 in place on the connector. Since the connector is mechanically held in place by PCB 600, it is much easier to solder the connector onto the board. Further, this approach still allows a solder paste screen print then solder re-flow assembly process. Thus, the new RF connector can be soldered onto the board along with surface mount electronic components that comprise a circuit on PCB 600. Mechanical assembly is straightforward. Referring to FIG. 6, the new RF connector's center conductor pin 650 is aligned with the microstrip transmission line 605, and slots 610 are aligned with the edge of PCB 600. Center pin 650 is significantly shorter on the new RF connector than pin 115 on an old connector, thus allowing the new RF connector to pivot in the opposite direction as compared to the old connector, during the installation process. Step 1 is shown by arrow 640 and indicates the assembly motion that pushes the connector onto the edge of PCB 600. Slots 610 go over the edge of PCB 600, until the PCB 600 hits the back of slots 610. Pegs 620 and 630 are then aligned with holes 615 and 625 from the bottom of PCB 600. The step 2 assembly motion is shown by arrow 645, where a pivoting motion snaps pegs 620 and 630 into PCB holes 615 and 625. The new RF connector is now mechanically aligned and held in place for the soldering process.

Figure 7:
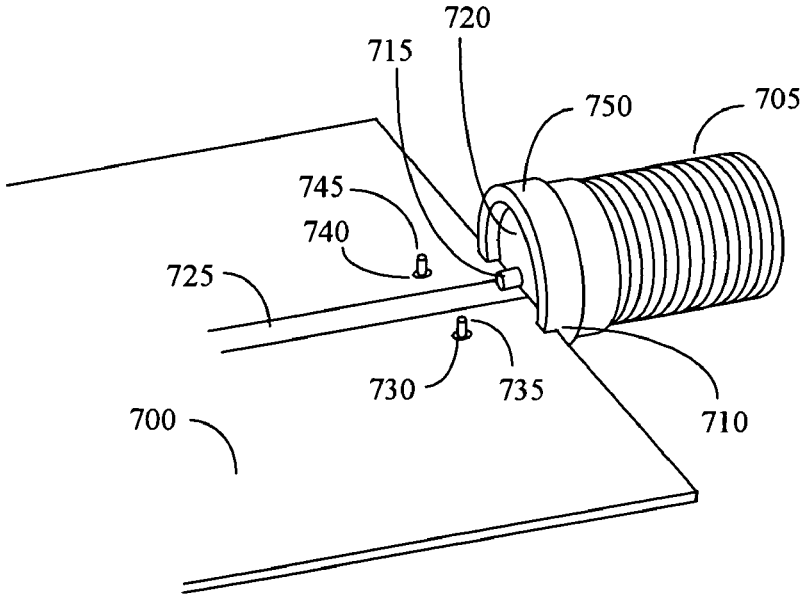
FIG. 7 is an isometric view of a PCB top with the new RF connector attached.
Figure 8:
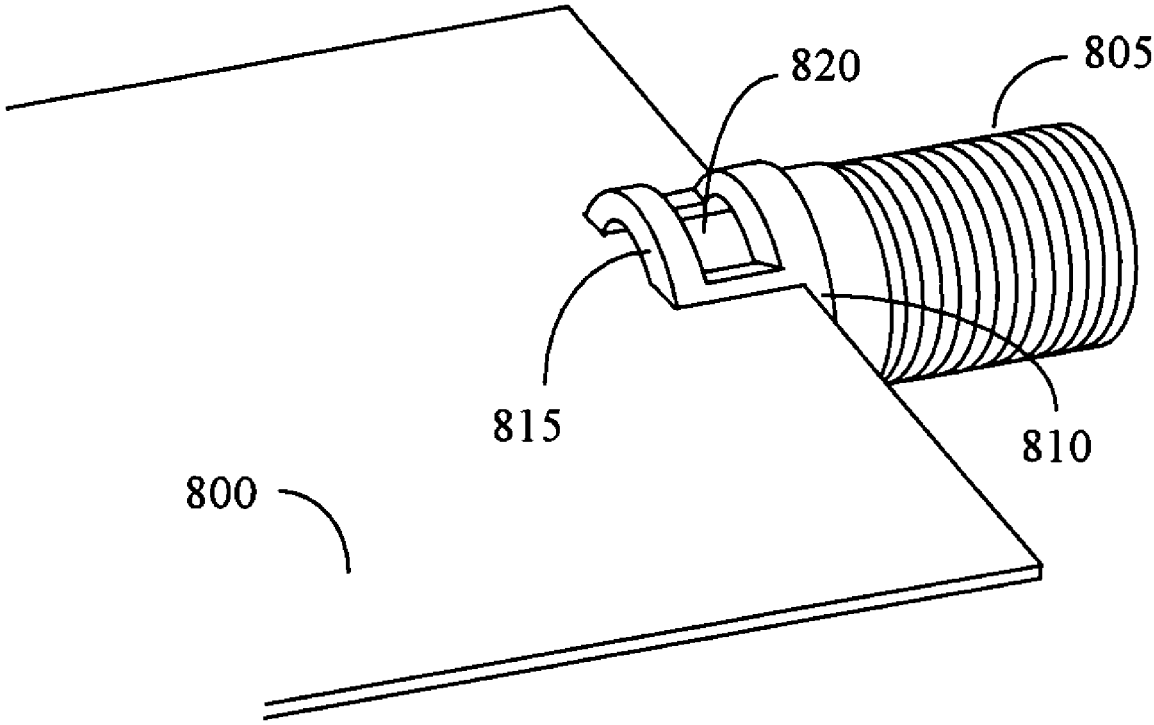
FIG. 8 is an isometric view of a PCB bottom with the new RF connector attached.

FIGS. 7 and 8 show the new RF connector attached to a PCB 700 (800) that has solid copper covering the entire bottom side. Threads 705 (805) are shown as the method to attach an RF cable or RF adapter to the new RF connector, but a BNC or push-on connection such as an SMB type are also possible.

FIG. 7 shows the PCB 700 top side with the new RF connector attached. Note that pegs 735 and 745 are shown protruding through PCB holes 730 and 740. The back of slot 710 is up against the edge of PCB 700. This ensures that pegs 735 and 745 are aligned with holes 730 and 740 right before the connector is pivoted and snapped into place onto PCB 700. The new RF connector locates the shroud 220 on the bottom for attachment to the PCB, thereby significantly reducing the parasitic capacitance on the end of the microstrip transmission line 725 when compared to a connector that has its shroud on top over the transition area of the microstrip transmission line 725. The new RF connector outer conductor 750 slightly overlaps the PCB edge to form the slots 710 that capture the PCB edge and hold the new RF connector onto the PCB edge. Connector center conductor pin 715 is significantly shorter than a conventional center conductor pin 415 so as to allow the present invention connector to pivot during the assembly process, but also to lower additional parasitics at the PCB/connector interface. The gap 410 of the old connector has been eliminated from the new RF connector. Note that PCB 700 is pushed against insulator 720. Insulator 720 is the insulator that separates the inner conductor from the outer conductor of the connector coaxial section. Thus, the coaxial section of the connector immediately joins the microstrip section of the PCB with minimal impedance discontinuities. Thus, as FIG. 7 shows, the impedance discontinuity given by the gap 410 of the old connector and the parasitic capacitance added by shroud 220 of the old connector have been virtually eliminated by the new RF connector.

FIG. 8 shows the PCB 800 bottom side with the present invention RF connector attached. The present invention RF connector has the shroud 815 on the bottom of PCB 800 as opposed to the top of the PCB. Shroud 815 forms the bottom part of slots 810 and provides a good outer shield ground from the connector to the PCB. Soldering the shroud right to the PCB 800 edge would be difficult if not impossible without window 820 in the shroud 815. This window allows a fillet of solder to be placed right to the PCB edge therefore allowing a good solder connection from the new RF connector outer shield ground to the PCB 800 bottom ground plane.

Figure 9:
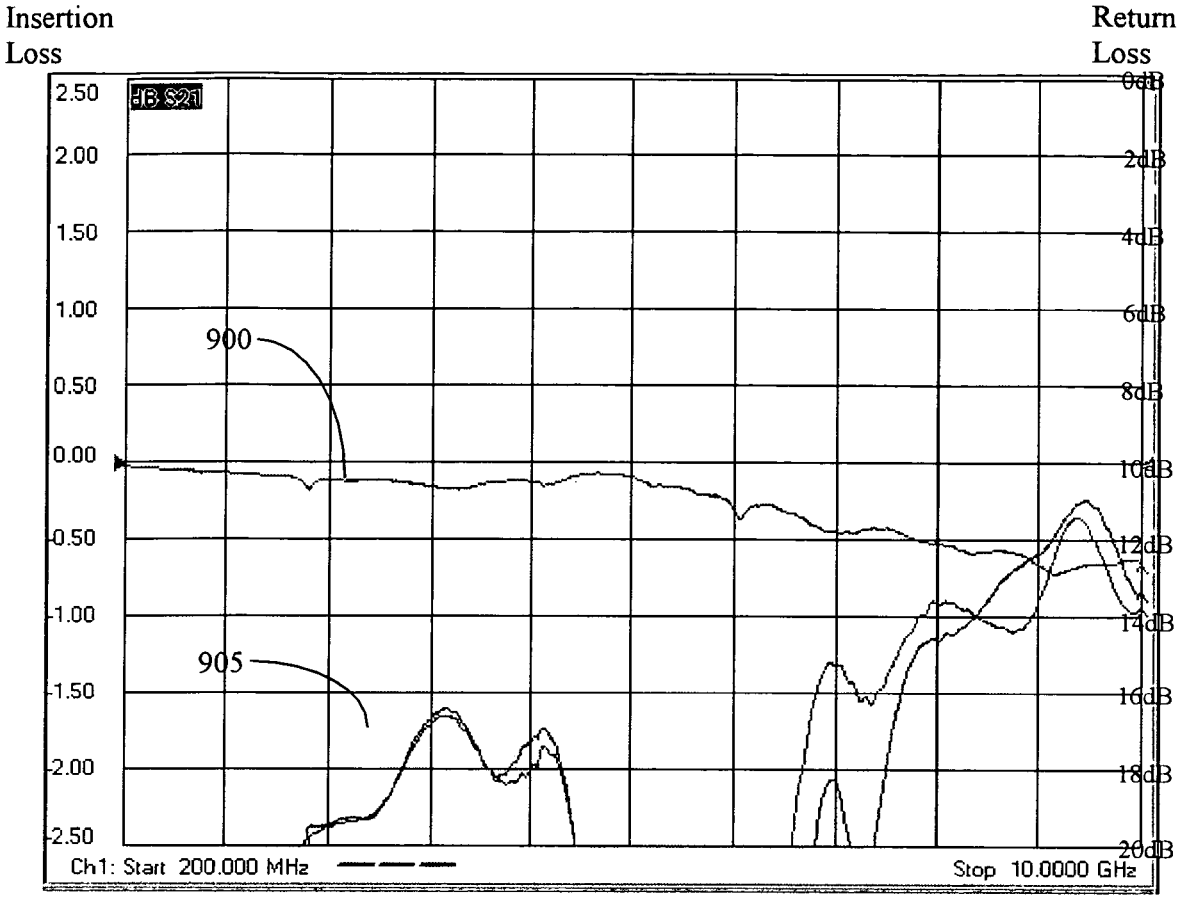
FIG. 9 is an insertion loss and input and output return loss versus frequency plot of the new RF connector.

FIG. 9 plots insertion loss 900 and input and output return loss 905 versus frequency for the present invention RF connector. Ideally, insertion loss should be 0 dB and return loss should be ∞dB at all frequencies. The present invention RF connector works at frequencies beyond 10 GHz as shown in the plot since it has around 0.5 dB insertion loss and better than 10 dB return loss above 10 GHz.

As should be appreciated from the preceding discussion, the current invention in its simplest form comprises a coaxial to transmission line connector that has a center conductor with a first end and a second end and a coaxial dielectric region coincident to and substantially surrounding the center conductor. An outer conductor is coincident to and substantially surrounds the dielectric. A first port is coupled to the outer conductor at the first end of the center conductor. The first port is adapted to attach a coaxial cable, e.g., it may be terminated with a male or female connector that substantially resembles an "F" connector, male or female SMA connector, or any other suitable electrical connector. A second port is coupled to the first port and adapted to couple a signal between the coaxial cable and a microstrip transmission line associated with an electrical device. The second port has a dielectric area following termination of the outer conductor at the second port and termination of the coaxial dielectric region. As configured in the instant invention, the dielectric area presents a uniform electromagnetic transition region in an area where the second end of the center conductor couples with the microstrip transmission line. This configuration minimizes any impedance discontinuity due to non-uniform electromagnetic fields at a point of transition between coaxial and microstrip transmission lines. The second port further has an attachment area with a windowed electrical attachment point for allowing electrical coupling between the outer conductor of the coaxial to transmission line connector and a ground reference of the electrical device. The attachment area also has at least one mechanical alignment point and a corresponding reference pivot point. The reference pivot point is located substantially co-planar at the termination of the coaxial dielectric region at the second port of the coaxial to transmission line connector. The at least one mechanical alignment point and the corresponding reference pivot plane serve to automatically align the coaxial to transmission line connector to the electrical device, thus insuring accurate and repeatable mechanical assembly. This easily repeatable assembly allows mass production of electrical devices utilizing the coaxial to transmission line connector because both mechanical alignment and resulting electrical characteristics are achieved with minimal effort. The assembled coaxial to transmission line connector operates to produce optimal amplitude and phase transfer characteristics while coupling the signal between the coaxial cable and the microstrip transmission line.

The coaxial to transmission line connector is preferably designed to have a characteristic impedance of substantially 75 ohms. This facilitates an optimal transition between a 75 ohm coaxial cable and the 75 ohm microstrip transmission line associated with the electrical device. Based on the present invention, a skilled artisan can adapt the connector described for use in practically any electrical system having most any characteristic impedance requirement, by modifying pertinent mechanical dimensions and material characteristics.

Finally, in attaching the coaxial to transmission line connector to the electrical device, the windowed electrical attachment point in the attachment area is substantially filled with a conductive material such as solder or the like. This creates sturdy mechanical coupling between the coaxial to transmission line connector and the electrical device. Moreover, the conductive material provides sound electrical coupling between the outer conductor of the coaxial to transmission line connector and the ground reference of the electrical device.

In summary, the coaxial to transmission line connector described herein extends the frequency range of RF PCB (printed circuit board) connectors while maintaining an easy method for attachment to a PCB. Impedance discontinuities are minimized at the coaxial-to-microstrip interface by limiting parasitics that arise from the physical structure of the RF connector in the vicinity of a PCB transition. Parasitic capacitance negatively influences the microstrip transmission line that attaches the RF circuit to the RF connector if the connector metal shroud that allows mechanical attachment to the PCB is located in close proximity to the microstrip transmission line. Conventional RF connectors introduce a gap between the microstrip transmission line (PCB) and the coaxial structure of the connector itself, which in turn, limits the upper frequency range of the connector. The new RF connector eliminates this gap for significantly improved performance. The proposed RF connector locates the metal shroud on the ground-plane side of the PCB, opposite from the PCB side containing the transmission line transition region, while allowing a much simpler and robust attachment to the PCB. The result is nearly eliminating all unwanted parasitic capacitance in the transition area of the microstrip transmission line. A windowed slot is introduced in the new connector metal shroud to allow easy soldering of the connector outer conductor to the PCB ground plane. The connector center conductor (or pin) is shortened on the PCB end of the connector, which still allows a pivot action as the connector is snapped into place on the PCB during assembly while maintaining sufficient contact for attachment to the microstrip transmission line.

It will be appreciated by persons of ordinary skill in the art that various embodiments of the present invention are not limited to what has been particularly shown and described herein above. A variety of modifications and variations are possible in light of the above teachings without departing from the scope and spirit of the invention, which is limited only by the following claims.

What is claimed is:

1. A coaxial to transmission line connector, comprising:

a center conductor having a first end and a second end;

a coaxial dielectric region coincident to and substantially surrounding the center conductor;

an outer conductor coincident to and substantially surrounding the dielectric;

a first port coupled to the outer conductor at the first end of the center conductor, the first port adapted to attach a coaxial cable; and a second port coupled to the first port and adapted to couple a signal between the coaxial cable and a microstrip transmission line associated with an electrical device, the second port further comprising an attachment area with a windowed electrical attachment point allowing electrical coupling between the outer conductor of the coaxial to transmission line connector and a ground reference of the electrical device, wherein the windowed electrical attachment point comprising the attachment area is substantially filled with a conductive material that creates sturdy mechanical coupling between the coaxial to transmission line connector and the electrical device and further serves to provide sound electrical coupling between the outer conductor of the coaxial to transmission line connector and the ground reference of the electrical device.

2. The coaxial to transmission line connector of claim 1 wherein the second port has a dielectric area following termination of the outer conductor at the second port and termination of the coaxial dielectric region, the dielectric area presenting a uniform electromagnetic transition region in an area where the second end of the center conductor couples with the microstrip transmission line, thereby minimizing any impedance discontinuity due to non-uniform electromagnetic fields at a point of transition between coaxial and microstrip transmission lines.

3. The coaxial to transmission line connector of claim 1 wherein the attachment area further has at least one mechanical alignment point and a corresponding reference pivot point, the reference pivot point being located substantially co-planar at the termination of the coaxial dielectric region at the second port of the coaxial to transmission line connector, the at least one mechanical alignment point and the corresponding reference pivot plane serving to automatically align the coaxial to transmission line connector to the electrical device to insure accurate and repeatable mechanical assembly resulting in the coaxial to transmission line connector operating to produce optimal amplitude and phase transfer characteristics while coupling the signal between the coaxial cable and the microstrip transmission line.

4. The coaxial to transmission line connector of claim 1 having a characteristic impedance of substantially 75 ohms.

5. The coaxial to transmission line connector of claim 1 wherein the microstrip transmission line associated with the electrical device has a characteristic impedance of substantially 75 ohms.

6. The coaxial to transmission line connector of claim 1 wherein the conductive material comprises solder.

7. A coaxial to transmission line connector, comprising:

a center conductor having a first end and a second end;

a coaxial dielectric region coincident to and substantially surrounding the center conductor;

an outer conductor coincident to and substantially surrounding the dielectric; and a port adapted to couple a signal between the coaxial cable and a microstrip transmission line associated with an electrical device, the port having a dielectric area following termination of the outer conductor at the port and termination of the coaxial dielectric region, the dielectric area presenting a uniform electromagnetic transition region in an area where the second end of the center conductor couples with the microstrip transmission line, thereby minimizing any impedance discontinuity due to non-uniform electromagnetic fields at a point of transition between coaxial and microstrip transmission lines, the port further comprising an attachment area with a windowed electrical attachment point allowing electrical coupling between the outer conductor of the coaxial to transmission line connector and a ground reference of the electrical device, the attachment area further having at least one mechanical alignment point and a corresponding reference pivot point, the reference pivot point being located substantially co-planar at the termination of the coaxial dielectric region at the port of the coaxial to transmission line connector, the at least one mechanical alignment point and the corresponding reference pivot plane serving to automatically align the coaxial to transmission line connector to the electrical device to insure accurate and repeatable mechanical assembly resulting in the coaxial to transmission line connector operating to produce optimal amplitude and phase transfer characteristics while coupling the signal between the coaxial cable and the microstrip transmission line, wherein the windowed electrical attachment point comprising the attachment area is substantially filled with a conductive material that creates sturdy mechanical coupling between the coaxial to transmission line connector and the electrical device and further serves to provide sound electrical coupling between the outer conductor of the coaxial to transmission line connector and the ground reference of the electrical device.

8. The coaxial to transmission line connector of claim 7 having a characteristic impedance of substantially 75 ohms.

9. The coaxial to transmission line connector of claim 7 wherein the microstrip transmission line associated with the electrical device has a characteristic impedance of substantially 75 ohms.

10. The coaxial to transmission line connector of claim 7 further comprising a first port coupled to the outer conductor at the first end of the center conductor, the first port adapted to attach a coaxial cable.

11. The coaxial to transmission line connector of claim 7 wherein the conductive material comprises solder.

12. A coaxial to transmission line connector, comprising:

a center conductor having a first end and a second end;

a coaxial dielectric region coincident to and substantially surrounding the center conductor;

an outer conductor coincident to and substantially surrounding the dielectric;

a first port coupled to the outer conductor at the first end of the center conductor, the first port adapted to attach a coaxial cable; and a second port coupled to the first port and adapted to couple a signal between the coaxial cable and a microstrip transmission line associated with an electrical device, the second port having a dielectric area following termination of the outer conductor at the second port and termination of the coaxial dielectric region, the dielectric area presenting a uniform electromagnetic transition region in an area where the second end of the center conductor couples with the microstrip transmission line, thereby minimizing any impedance discontinuity due to non-uniform electromagnetic fields at a point of transition between coaxial and microstrip transmission lines, the second port further comprising an attachment area with a windowed electrical attachment point allowing electrical coupling between the outer conductor of the coaxial to transmission line connector and a ground reference of the electrical device, the attachment area further having at least one mechanical alignment point and a corresponding reference pivot point, the reference pivot point being located substantially co-planar at the termination of the coaxial dielectric region at the second port of the coaxial to transmission line connector, the at least one mechanical alignment point and the corresponding reference pivot plane serving to automatically align the coaxial to transmission line connector to the electrical device to insure accurate and repeatable mechanical assembly resulting in the coaxial to transmission line connector operating to produce optimal amplitude and phase transfer characteristics while coupling the signal between the coaxial cable and the microstrip transmission line, wherein the windowed electrical attachment point comprising the attachment area is substantially filled with a conductive material that creates sturdy mechanical coupling between the coaxial to transmission line connector and the electrical device and further serves to provide sound electrical coupling between the outer conductor of the coaxial to transmission line connector and the ground reference of the electrical device.

13. The coaxial to transmission line connector of claim 12 having a characteristic impedance of substantially 75 ohms.

14. The coaxial to transmission line connector of claim 12 wherein the microstrip transmission line associated with the electrical device has a characteristic impedance of substantially 75 ohms.

15. The coaxial to transmission line connector of claim 12 wherein the conductive material comprises solder.

* * * * *